US006306214B1

(12) United States Patent
Cowie et al.

(10) Patent No.: US 6,306,214 B1
(45) Date of Patent: Oct. 23, 2001

(54) MOLTEN METAL IMMERSION BATH FOR WIRE FABRICATION

(75) Inventors: Gordon Bernard Cowie; Andrew James Rawlings, both of Dorval (CA)

(73) Assignee: The I.C.E. Group, Dorval (CA)

( * ) Notice: Subject to any disclaimer, the term of this patent is extended or adjusted under 35 U.S.C. 154(b) by 0 days.

(21) Appl. No.: 09/365,396

(22) Filed: Aug. 2, 1999

(30) Foreign Application Priority Data

Feb. 3, 1999 (CA) ..... 2261100

(51) Int. Cl.[7] ..... B05C 11/00

(52) U.S. Cl. ..... 118/67; 118/69; 118/429; 118/602

(58) Field of Search ..... 118/420, 602, 118/429, 66, 67, 68, 692; 228/37; 427/434.6, 437.7, 436, 431, 434.3, 434.5, 329

(56) References Cited

U.S. PATENT DOCUMENTS 2,728,629 * 12/1955 Blomberg .
3,923,003 12/1975 Carden .
3,956,537 5/1976 Raymond .
4,053,663 * 10/1977 Caldwell et al. .
4,323,604 4/1982 Fukuda et al. .
4,418,641 * 12/1983 Nakashima et al. ..... 118/429
4,717,589 * 1/1988 Ishikawa et al. .
4,814,210 3/1989 Ackermann et al. .
4,869,199 * 9/1989 Zaman .
5,527,563 6/1996 Unger et al. .
5,705,228 1/1998 Kornmann .
5,718,765 2/1998 Unger et al. .
5,736,199 4/1998 Blucher .
5,756,163 5/1998 Watanabe .

* cited by examiner

*Primary Examiner*—Brenda A. Lamb
(74) *Attorney, Agent, or Firm*—McFadden, Fincham

(57) ABSTRACT

An apparatus and related process for immersing a moving wire within a both of molten metal is applicable to wire forming processes. A flat-bottomed tray has at one end a nozzle for dispersing molten metal across the floor of the tray, from a first end to a second end, in a sheetlike flow. The nozzle preferably includes a slot-like opening, and is associated with a chamber for receiving a supply of pressurized molten metal for discharge through the slot. The metal is discharged with sufficient velocity to create a hydraulic jump or standing wave, whereby the crest of the wave is elevated above the tray end walls. Within the wave, molten metal experiences a turbulent flow in a direction against the travel of the wire array. The wire array passes through the wave, thereby experiencing immersion while being drawn through the apparatus in a straight path without substantial declination. An arrangement of pumps, heaters and a reservoir for the metal permit the metal to be re-circulated through the device and maintained in a molten state.

14 Claims, 4 Drawing Sheets

MOLTEN METAL IMMERSION BATH FOR WIRE FABRICATION

FIELD OF THE INVENTION

The present invention relates to the manufacture of metal wire, rod, and the like, and in particular to apparatuses and processes for immersing a moving wire within a bath of molten metal such as zinc or lead, for the purpose of coating or quenching the wire.

BACKGROUND OF THE INVENTION

Within the production of wire or metal rod (which will be referred to herein generically as "wire"), immersion of the wire within a bath of molten metal is required at one or more stages of production. For example, upon exiting the austinizing furnace the wire is quenched within a quench furnace. Conventionally, the quench furnace comprises a bath of molten lead or other metal, for rapidly cooling the hot wire from the furnace temperature of about 950° C. to about 535° C. Conventionally, a continuous length of wire is drawn from the furnace at a rapid rate, passes through the quench furnace and subsequently through various downstream, processing means. These latter optionally include a coating station, in which the wire is coated by immersion into a bath of liquid metal such as zinc. Conventionally wire is drawn through the various stations in a generally horizontal direction.

Within conventional manufacturing processes, a molten metal immersion bath comprises a chamber or housing, in which the wire enters the housing at a level somewhat above the surface of the liquid metal, and is deflected downwardly into the liquid by means of an arrangement of sinkers or the like. The wire is subsequently directed back to a higher level to exit the chamber. The downward deflection is required in light of the difficulty in achieving a sealable opening within the chamber at a level below the surface of the liquid. To prevent leakage of the metal, the chamber must be fully sealed below the liquid surface level, thus necessitating within the prior art a tortuous path for the wire. The wire is drawn downwardly into the bath by the application of a relatively considerable downward force, in light of the high tension applied to the wire and the relatively high speed at which the wire is drawn through the fabrication stations. As a result considerable wear is typically experienced by the various sinker arrangements, as well as the wire handling equipment associated with drawing the moving wire through the tortuous path associated with immersion of the wire within a bath. Further, the wire itself experiences stress, leading to cracks, weaknesses and the like.

In order to prevent strain on the wire, leading to cracks, fractures, or weakened portions, it is desirable that the wire follow a generally straight linear path and any deflection from the horizontal be minimized.

It has been proposed to provide a wire coating station wherein the wire travels through the station without deflection from the horizontal. In particular, U.S. patent documents U.S. Pat. No. 3,956,537 (Raymond), U.S. Pat. No. 5,527,563 (Unger et al.) and U.S. Pat. No. 5,718,765 (Unger et al.) propose generally trough-like arrangements, with the wire passing through the trough in each case in a substantial horizontal direction without downward deflection. A coating layer is sprayed onto the wire as it passes through the trough, with a trough serving to contain the coating material in the regions surrounding the wire. However, this arrangement is not suitable for quenching hot wire exiting an austinizing furnace, as it does not fully immerse the wire within a bath, nor for a hot metal coating station requiring complete immersion within a molten metal bath.

There has not been prior to the present invention proposed any suitable arrangement for immersing wire within a bath of molten metal or the like, wherein the wire is conveyed through a bath in a substantially straight, horizontal, non-tortuous path.

The benefits that may be achieved by providing such an arrangement include:

- improved metallurgical structures resulting from the lack of stress on the metal from the minimal distortion of the wire;
- maintenance savings throughout the production line, as a result of avoiding the need for ceramic or metal sinkers, pulleys or the like for displacing wire downwardly into a bath;
- reduction of strain on feeding and tensioning equipment, as a result of a more efficient passage of the wire through the molten metal baths, without the necessity of drawing a wire through displacement means;
- reduction in manpower, production costs and scrap product, and increased speed of production and productivity as a result of the above.

As well, the overall length of the quench or coating stations may be reduced by application of the present invention, thereby further reducing costs associated with wire production.

In a further aspect, the molten metal within a conventional bath typically substantially circulates relatively slowly or not at all. As a result, a layer of laminar flow is created at the wire surface as the wire is drawn through the liquid at a high speed. This can result in localized fluctuations in temperature, wherein the liquid within the zone of laminar flow is elevated in temperature, resulting in a less efficient quenching or coating operation. More efficient coating and quenching processes may be achieved by imparting a velocity, and in particular a turbulent flow, to the molten metal within the bath, thereby minimizing the laminar flow effects. Further, improved processes may be achieved by directing a turbulent, relatively rapid flow in a direction countercurrent to the direction of travel of the wire within the bath. If the flow is imparted with sufficient velocity and turbulence, the laminar flow layer which normally surrounds wire drawn through a liquid bath is disrupted.

The present invention operates on the principle of providing within a molten metal bath a volume of molten metal that is elevated at a central region of the bath relative to the ends, thereby permitting the wire to pass through this elevated region in a straight path without downward deflection. The present invention also relies on a means for imparting a velocity to the molten metal within the bath, which conveniently is in a direction against the wire travel direction, and providing a degree of turbulence within the molten metal. The turbulence and the counterflow effectively disturb the laminar flow layer which normally surrounds wire traveling through a liquid bath, thereby increasing the effectiveness of the molten metal properties within a quenching operation or other stage requiring full immersion of the moving wire.

SUMMARY OF THE INVENTION

An object of the invention is to provide an improved apparatus and method for immersing wire within a liquid metal bath, for the purpose of annealing or coating the wire or other like purpose within a wire forming process. More particularly, the object is to immerse a moving wire within a bath, without downward deflection of the wire. In order to achieve these objects, the present invention provides an apparatus and method for immersing a moving wire within a molten metal bath wherein the liquid forms a hydraulic jump that effectively elevates a volume of the liquid within a standing wave configuration whereby a wire may be drawn in a substantially straight path through the standing wave.

It is a further object to provide an immersion bath characterized by a turbulent flow of molten metal in a direction against the wire travel direction, in order to effectively disrupt the layer of laminar flow adjacent to the wire, thereby improving the efficiency and efficacy of the immersion.

According to one aspect, the present invention comprises an apparatus for use in association with a wire forming arrangement, for immersing within a liquid metal bath a wire traveling in generally straight linear horizontal path, comprising:

an elongate tray having opposed ends and elongate sides, a flat floor, a dam at a first end of said tray and sidewalls along the side edges of the tray for maintaining a volume of liquid metal within said tray;

support means for supporting a wire at a height above said floor along a substantially horizontal plane;

a source of pressurized liquid metal, preferably comprising at least one pump means suitable for delivering a relatively high pressure and high volume stream of molten metal; and a nozzle at a first end of said tray for directing the liquid from said source in a sheetlike flow along said floor towards a second end of said tray and over said dam, with sufficient velocity to generate by means of a hydraulic jump a standing wave of said liquid within said tray wherein the crest of said wave is at a level above said height thereby immersing a portion of said wire within said liquid at said standing wave.

In a preferred embodiment, the liquid is recirculated within the system. Further, the liquid cascades over the dam after contact with the wire into a reservoir pan, and is recirculated to the nozzle by a pump means or the like.

Preferably, the nozzle means comprises an elongate chamber communicating with the liquid source, having a slot-like outlet defined by spaced apart parallel plate means defining an inner space communicating with said chamber and opening onto the floor of the tray in a direction parallel to the tray floor. The slot-like opening has a height defined by the spacing of the parallel plate means and a width which in one aspect generally corresponds to the length of the chamber.

The relative dimensions and flow rate of the respective components and in particular the dimensions of the slot-like nozzle are an important aspect of providing a suitable hydraulic jump within the tray. The spaced apart parallel plates in the nozzle means of the preferred version have a spacing therebetween of about 6 mm, and a width of about three feet and said source of liquid metal is adapted to provide said metal at a pressure of between 22 psi and 30 psi at a flow rate of about 110 kg/sec. of molten lead. Within these parameters, the resulting velocity of the lead exiting the nozzle is between about 10 and 15 ft/sec. In general terms in one aspect of the invention, the slot dimensions and the liquid flow rate that achieve a suitable hydraulic jump conforms to the following formula:

$$D = \frac{d}{2}\left[\sqrt{1 + \frac{8}{g} \times \frac{Q^2}{L^2 d^3}} - 1\right]$$

where

D=wave height d=slot height (distance "x")

g=gravitational constant

Q=flow rate

L=slot width (distance "z")

It is understood that depending on the selected speed at which the wire array is drawn through the apparatus and the desired immersion time, the slot dimension and flow rate parameters will be selected according to the above formula to achieve a suitable height D of the standing wave. Preferably, D is selected to achieve a minimum six second immersion of a wire array drawn through the apparatus.

The invention comprises in a further aspect:

a pressurized source of molten metal;

a tray having a substantially flat floor, first and second opposed ends, elongate opposed sides and sidewalls along the side edges;

a nozzle at a first end of said tray communicating with said pressurized source, for directing a stream of said liquid onto the floor of said tray, in a sheet like flow towards an opposed second end of said tray;

wire entry and exit means within said tray permitting wire to be drawn through said tray in a straight, linear generally horizontal path from said second end to said first end thereof substantially parallel to said floor and at a height elevated above the floor;

molten metal recirculating means for removing said liquid from said second end of said tray and recirculating said liquid to said pump means;

whereby said pump means are adapted to pump the molten metal through said nozzle with sufficient velocity to create a hydraulic jump whereby a standing wave is created of said liquid of sufficient height to fully immerse a portion of the wire within the molten metal, with the liquid within the standing wave characterized by a relatively turbulent flow of said liquid in a direction against the direction of travel said wire passing through said tray.

In a further aspect, the invention comprises a method for immersing a wire within a bath of molten metal, comprising the steps of:

providing an elongate tray having opposed ends and elongate sides, a flat floor, a dam at a first end of said tray and sidewalls for maintaining a liquid metal within said tray;

support means for supporting the wire at a height above said floor along a substantially horizontal plane;

a source of pressurized liquid metal such as a pump means; and a nozzle at a second end of said tray;

drawing the wire above the floor of the tray in a generally horizontal, straight path;

directing said liquid from said source in a sheetlike flow along said floor towards said second end of said tray and over said dam, with sufficient velocity to generate a hydraulic jump consisting of a standing wave of said liquid within said tray wherein the crest of said wave is at a level above said height to substantially immerse said wire within said liquid at said standing wave; and receiving said liquid flowing over said dam and recirculating said liquid into said source.

Although within the preferred embodiments of the invention the wire is drawn along axially relative to the elongate axis of the wire, it is contemplated that with suitable modifications the invention may operate in connection with a transverse movement of the wire.

Having briefly characterized the salient features of the present invention, a detailed description of a preferred embodiment will now be described. Further aspects of the invention will become apparent within the following detailed description.

DETAILED DESCRIPTION OF THE PREFERRED EMBODIMENT

Figure 1:
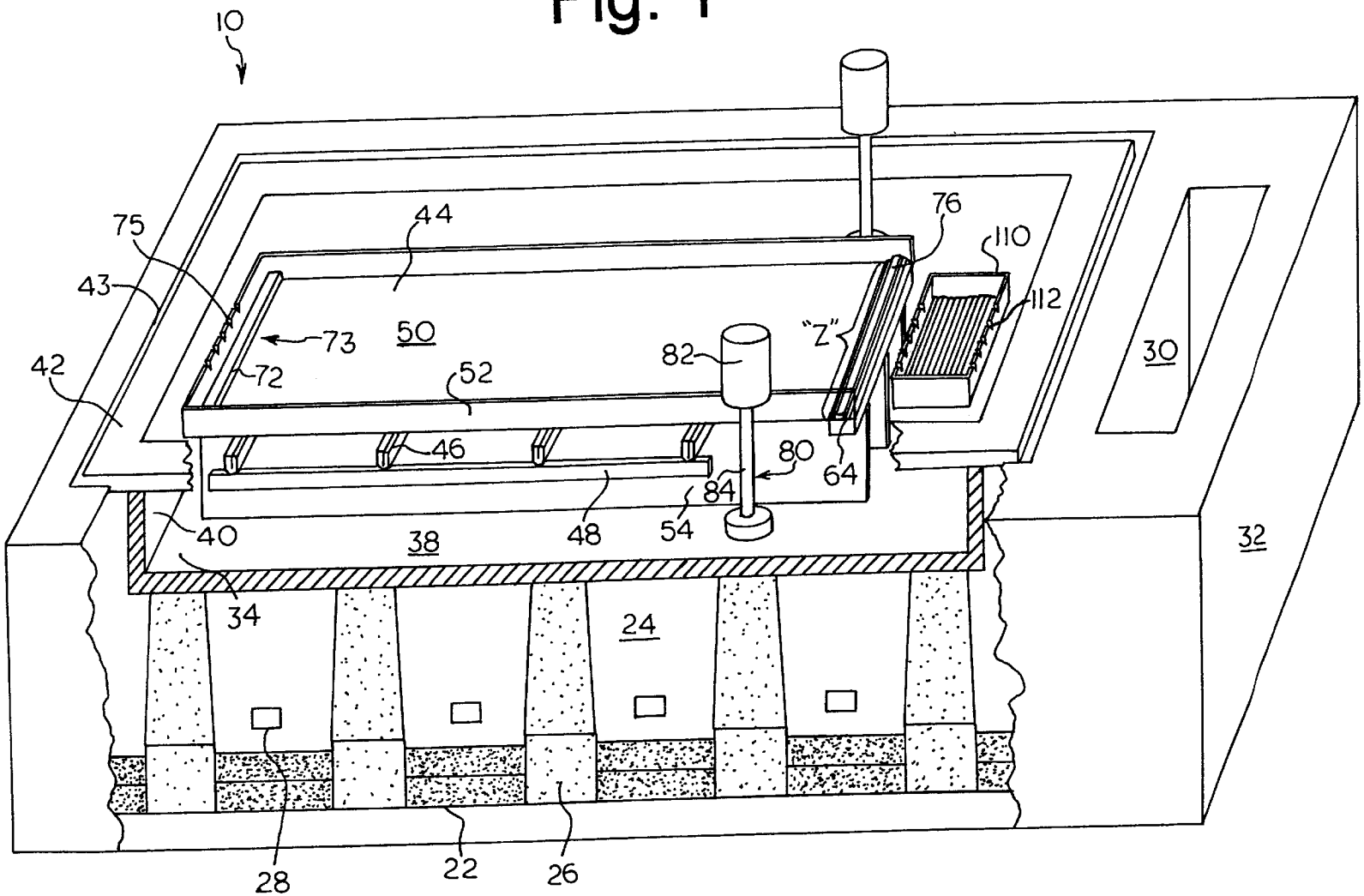
FIG. 1 is a perspective view of a first embodiment of the present invention, in the form of a station for quenching wire exiting the austinizing furnace.
Figure 2:
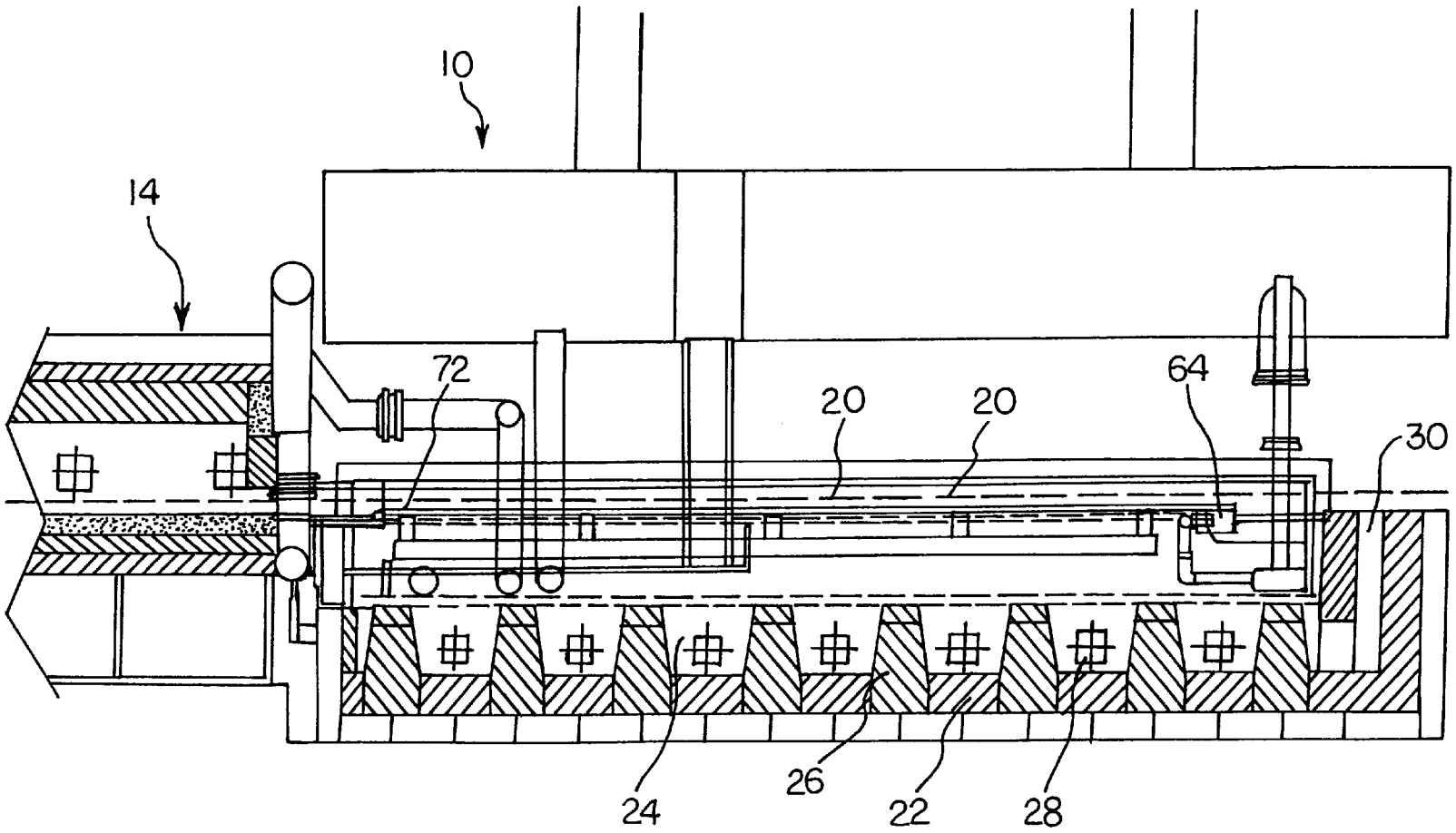
FIG. 2 is a side elevational view of a quench station according to the first embodiment present invention, and including as well an upstream austinizing furnace.

Referring to FIGS. 1 and 2, a first embodiment of the present invention comprises in general terms a quench station designated globally as 10. It will be seen that the quench station 10 described herein may optionally be adapted to serve as a metal coating bath station within a wire production line. The quench station is positioned downstream of an austinizing furnace 14 (see FIG. 2) within a generally conventional wire forming process. Wire 20 exits the austinizing furnace 14 at an elevated temperature, and enters the quench station 10 on a continuous basis. The quench station 10 includes a base 22, formed from refractory brick or other like heat tolerant and sturdy material forming a rectangular walled structure. The base has a hollow interior 24 which houses therein an array of supporting piers 26 extending laterally across the base and resting on the underlying floor or subfloor. An array of burners 28 is housed within the base, between the piers 26. The spaces between the piers thus comprise multiple firing chambers, which vent through a burner exhaust funnel 30 at one end of the base. The base is substantially enclosed within a metal shell 32. An open-topped lead reservoir pan 34 is housed within the base 36. The pan 34 is generally rectangular with a floor 38 supported on the piers 26 and vertical sidewalls 40. A horizontal flange 42 forms an upper rim of the pan and effectively seals the interior of the base portion, thereby minimizing the escape of heated air and lead vapors from the interior of the base 22. The flange 42 fits within a corresponding recess 43 at the rim of the base, for sealing the interior of the base 22. The pan 34 is partly filled with molten lead or other metal, as will be described below.

An elongate rectangular tray 44 is mounted within the interior of the reservoir pan 34 and extends above the rim of the pan 34. The tray 44 is partly filled with liquid lead or other suitable molten metal, as will be described below. The tray rests on an array of laterally-oriented beams 46, which in turn are supported by a pair of longitudinal ribs 48 mounted to the inside faces of sidewalls 40 of the reservoir pan 34. The tray 44 comprises a substantially flat floor 50, and relatively low sidewalls 52. An array of fins 54 depend downwardly from the floor of the tray, extending into the interior of the reservoir pan. The fins serve as heat sinks, for effectively conveying heat upwardly from the molten lead within the reservoir pan 34, which in turn is heated by the burners 28, thereby maintaining the molten metal within the tray at an elevated temperature. The tray 44 is somewhat narrower than the reservoir pan and shorter in length, thereby leaving a gap between the respective ends of the tray and the reservoir pan. As will be described below, this permits liquid metal to cascade from an end of the tray 44 into the reservoir pan 34.

Molten lead 56 or other like suitable quench liquid circulates between the reservoir pan 34 and the tray 44 in a manner to be described below.

Figure 5:
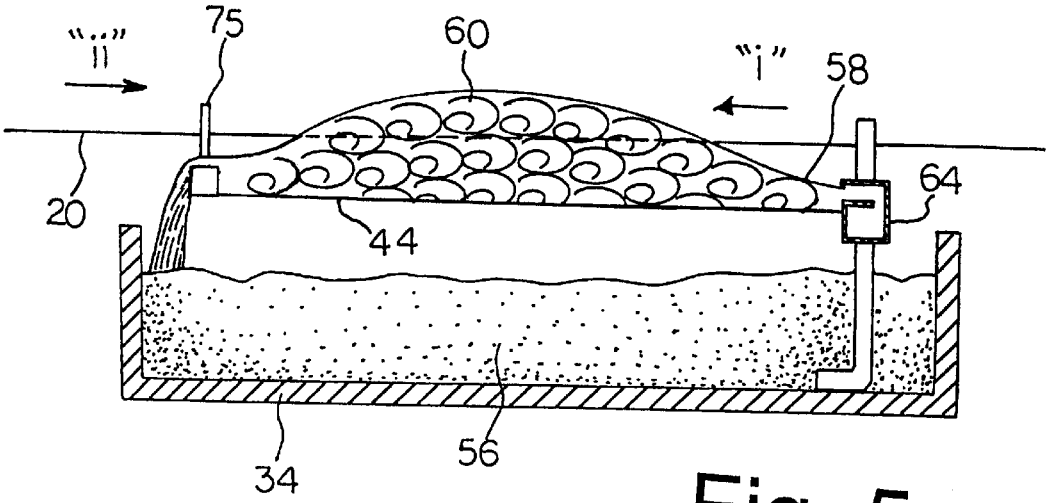
FIG. 5 is a schematic side elevational view of the invention, showing the quench station in operation.

The present invention operates on the principle of the molten metal 56 forming a "hydraulic jump" within the lead tray 44, illustrated schematically in FIG. 5. In particular, this effect is achieved by directing a relatively high velocity sheetlike jet 58 of the liquid along the floor of the tray, in a direction "i" countervailing the wire path direction "ii". The invention takes advantage of the friction generated by the relative movement of the liquid metal along the floor tray, whereby the lowermost liquid layer experiences drag against the tray floor relative to the upper liquid layers. This has the effect of decreasing the velocity of the liquid layer immediately adjacent to the tray floor while upper liquid layers travel at a higher relative velocity. In consequence, an effective standing wave or hydraulic jump 60 is created (exaggerated in FIG. 5 for clarity) downstream of the liquid source (relative to the direction of liquid travel), through which wire can be drawn in a substantially straight path without downward deflection from the horizontal.

Figure 6:
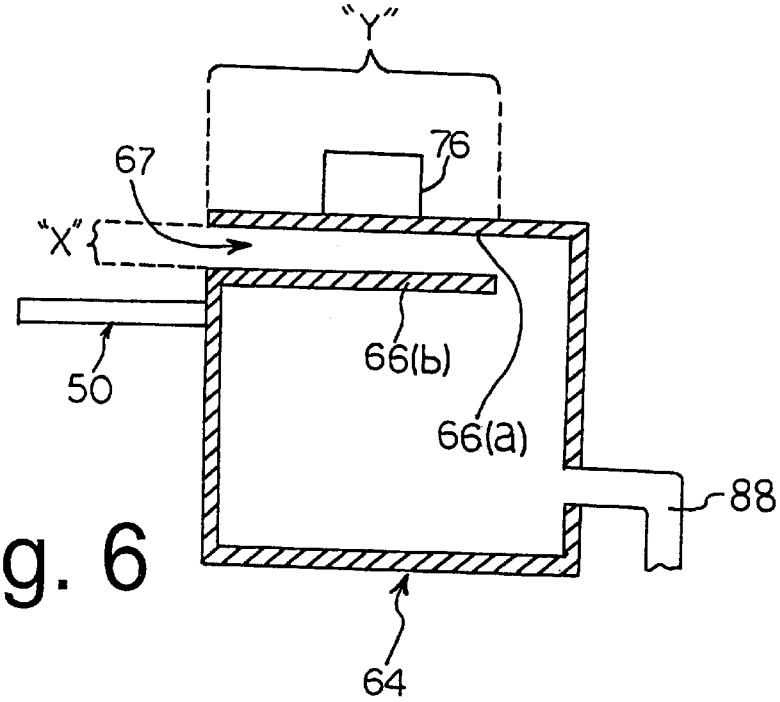
FIG. 6 is a sectional view of the header portion of the apparatus.

In order to force the sheetlike jet of liquid into the tray floor, the liquid metal 56 passes through a header 64 (shown more particularly in FIG. 6) mounted at a first end 65 of the lead tray 44. The header 64 comprises an elongate generally rectangular chamber which is formed from a single metal plate shaped to form an enclosure having a generally square cross section forming a bottom, top and sides. The top of the enclosure 64 is characterized by spaced apart, parallel overlapping plate sections 66(*a*) and (*b*), forming a slot-like nozzle region 67 between the plate portions 66(*a*) and (*b*). The distance between the plate sections (*a*) and (*b*), i.e., the slot height, is represented by "x" in FIG. 6. The length of the nozzle, i.e., the distance between the interior and exterior edges thereof, is represented by distance "y". The width of the nozzle corresponds generally to the length of the header and is represented as distance "z" on FIG. 1. As will be discussed below, the ratio between these respective dimensions, along with the liquid metal pressure, is important for achieving an effective hydraulic jump. The region 67 is open at its elongate sides and communicates along one side with the interior of the chamber, and along the opposing side with the exterior of the header and the interior of the tray 44. The nozzle region 67 thus forms an effective elongate (in width) nozzle for directing a sheetlike flow of liquid from the header into the interior of the lead tray 44 and onto the floor 50. The header 64 is mounted to extend slightly above the tray floor 50 whereby the nozzle 67 is elevated slightly above the tray floor to direct the flow of liquid metal exiting the header nozzle immediately adjacent the floor of the tray.

Liquid is retained within the pan by a dam 72 mounted at a second end 73 of the tray. Liquid spilling over the dam cascades directly into the reservoir pan below. The dam 72 also forms a support for the array of wires 20 being drawn through the tray. The dam is subject to wear as a result of contact with the wires and is readily replaceable. A wire guide 75 spans the second end of the tray and comprises a notched bar parallel to the tray floor. The guide 75 serves to maintain the wire array 20 in position relative to the tray 44.

A second, opposed wire support bar 76 is mounted to the header 64 parallel to and on the same horizontal plane as the dam 72. The second support bar likewise supports the wire array, and is readily replaceable. The respective spaced apart bars 72 and 76 thereby support the wire array 20 in a substantially horizontal position parallel to and elevated above the tray floor 50. The wires travel along their elongate axes from the second end of the tray 44 to the first end.

Figure 3:
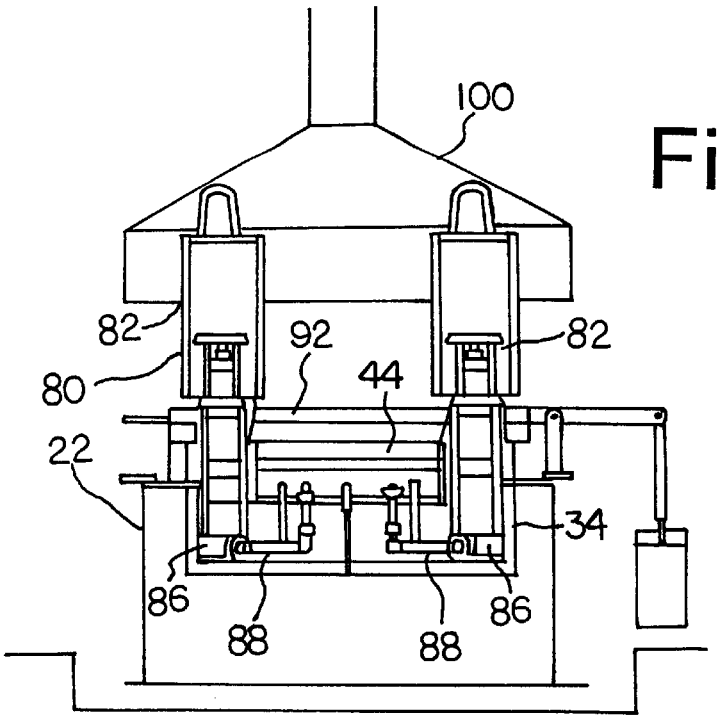
FIG. 3 is a side sectional view along line A—A of FIG. 2.

Molten lead 56 is circulated from the reservoir chamber 34, and into the header chamber 64 by means of a pair of high powered pumps 80 (seen more particularly in FIG. 3) suitable for pumping a high volume and pressure of liquid metal. Conveniently, the pumps are capable of together circulating at least about 110 kilograms per second of lead, and of generating a pressure within the header of approximately 22 psi on a continuous basis. The pump motors 82 are externally mounted on posts 84. The pump bodies 86 are mounted within the reservoir pan 34, and each communicates with the header for circulating molten lead from the pan into the header 64 by way of conduits 88. The pumps are adapted to operate on a continuous basis.

Molten lead 56 exiting the header 64 travels in a turbulent flow pattern, represented schematically in FIG. 5, and flows from the first end of the tray to the second end. At the second end of the tray, the molten lead flows over the dam and cascades into the reservoir.

Figure 4:
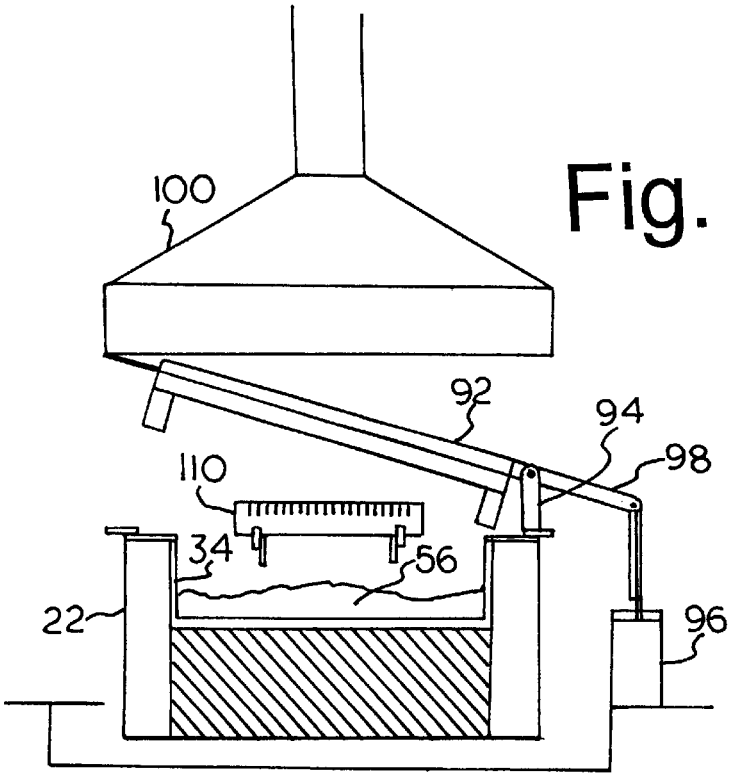
FIG. 4 is a cross sectional view along line B—B of FIG. 2, showing the cover in the open position.

The reservoir 34 and tray 44 are covered by an openable cover 92, thereby forming with the base 22 an effectively sealed enclosure, enclosing the apparatus and substantially preventing the release of lead vapors. The cover is hinged to a support wall 94. Opening and closing of the cover is assisted by means of a counterweight 96 suspended from a beam 98 extending from the cover. An overhead fume hood 100 captures escaping lead vapors. The cover 92 is seen in the closed position in FIG. 3 and in the open position in FIG. 4.

In operation, as shown in FIG. 5 (schematically), molten metal 56 is pumped from the reservoir 34 into the header chamber 64, from whence it exits through the nozzle 68 in a sheetlike movement, adjacent to and contacting the floor 50 of the lead tray. A sufficiently high velocity and the sheetlike flow pattern of the molten lead creates hydraulic "jump", resulting in a turbulent standing wave 60 formed of molten lead within the tray. The standing wave crests at a level above the first and second wire supports 72 and 76, as shown in FIG. 5. The tray sidewalls 52 prevent escape of the molten lead from the sides of the tray. Wire 20 exiting the austinizing furnace 14 passes over the dam 72 and travels in a straight linear path across the tray 44, substantially parallel to the floor 50. The wire 20 then exits the tray 44, with the wires passing over the header 64. As seen in FIG. 5, the wire 20 passes through the wave crest region 60 of molten lead, thereby quenching the wire. The turbulent flow within the standing wave ensures rapid cooling of the wire, thus permitting a relatively high velocity wire forming operation.

After passage through the lead tray 44, the wire array 20 passes over a conventional open-topped charcoal wipe box 110, the sidewalls of which are provided with guides 112 for directing the array of wires 20. The wire array 20 contact the charcoal 114 within the wipe box for removal of excess metal from the wire surface, in a generally conventional manner.

After passage through the above-described apparatus, the wire 20 is drawn through conventional downstream processing means, including wire handling means (not shown) for drawing the array of wire 20 through the above-described arrangement under tension.

In order to achieve a suitable hydraulic jump, whereby the wire array is immersed within liquid metal for a suitable period, the relative dimensions and operating parameters of the system are important. In order to achieve a suitable quench, a wire array is immersed within the lead bath for a suitable distance for achieving immersion for not less than six seconds.

As will be seen, achieving a suitable hydraulic jump for immersion of wire within liquid metal may be achieved in virtually any convenient scale. In order to achieve a suitable arrangement, the header nozzle and liquid metal delivery system should conform to the parameters identified in the formula:

$$D = \frac{d}{2}\left[\sqrt{1 + \frac{8}{g} \times \frac{Q^2}{L^2 d^3}} - 1\right]$$

where

D=wave height d=slot height (distance "x")

g=gravitational constant

Q=flow rate

L=slot width (distance "z")

It is understood that depending on the selected speed at which the wire array is drawn through the apparatus and the desired immersion time, the slot dimension and flow rate parameters will be selected according to the above formula to achieve a suitable height D of the standing wave. Preferrably, D is selected to achieve a minimum six second immersion of a wire array drawn through the apparatus.

In one version, the slot height may be about 6 mm., the slot length about three feet and molten lead is delivered at a pressure of between about 22 and 30 psi, thereby achieving a flow rate of about 110 kg/sec.

The present invention has been described and characterized by way of a specific embodiment thereof It will be seen by those skilled in the art to which this invention pertains that departures from and variations to the embodiment thus described are encompassed within the present invention, as the same is characterized by the appended claims.

We claim:

1. An apparatus for immersing within a liquid molten metal bath a wire moving in a generally straight horizontal path, comprising:

an elongate tray having opposed ends and elongate sides, a generally flat floor, a dam at a first end of said tray and sidewalls along said sides for maintaining a volume of said liquid metal within said tray with the liquid surface being at a first height;

support means for supporting said wire at a second height above said first height along a substantially horizontal plane;

a source of pressurized liquid metal;

a nozzle at a first end of said tray communicating with said source, said nozzle having a slot for directing; said liquid from said source in a sheet flow along said floor towards said second end of said tray and over said dam, with sufficient velocity to generate by means of a hydraulic jump a standing wave of said liquid within said tray wherein the crest of said wave is at a level above said second height thereby immersing a portion of said wire within said liquid at said standing wave;

recirculating means for receiving said liquid flowing over said dam and recirculating said liquid to said source; and the dimensions of said slot and said source for controlling the flow rate of said liquid conforming to the following formula:

$$D = \frac{d}{2}\left[\sqrt{1 + \frac{8}{g} \times \frac{Q^2}{L^2 d^3}} - 1\right]$$

Where

D=wave height d=slot height (distance "x")

g=gravitational constant

Q=flow rate

L=slot width (distance "z").

2. An apparatus as defined in claim 1, wherein said nozzle comprises an elongate chamber having an outlet defined by spaced apart parallel plate means defining said slot height and said slot width of said slot, said slot opening onto the floor of said tray in a direction parallel to the plane of said floor.

3. An apparatus as defined in claim 2, wherein said spaced apart parallel plates have a spacing therebetween forming said slot height of about 6 mm and said slot width of about 3 feet and said source is adapted to provide said liquid at a pressure of between 22 and 30 psi.

4. An apparatus as defined in claim 1, wherein said recirculating means comprises a reservoir pan mounted beneath said tray and said source comprises a pump means for pumping said liquid from said pan into said nozzle.

5. An apparatus as defined in claim 1, wherein said liquid is ejected through said nozzle at a velocity of about 10 ft./sec.

6. An apparatus as defined in claim 1, comprising an annealing station.

7. An apparatus as defined in claim 1 comprising a wire coating station.

8. A apparatus for immersing within a molten liquid metal bath a wire moving in a generally straight horizontal path axial with said wire, comprising:

a pressurized source of liquid metal;

a tray having a substantially flat floor, first and second opposed ends, elongate opposed sides and sidewalls along said sides;

a nozzle at a first end of said tray communicating with said source, said nozzle having a slot for directing a stream of said liquid onto the floor of said tray, in a sheet flow parallel to the floor of said tray, towards an opposed second end of said tray, said liquid having a surface at a first height;

wire entry and exit means within said tray supporting said wire as said wire is drawn in a straight, linear path from said second end of said tray to said first end thereof, substantially parallel to said floor and at a second height above said first height;

liquid recirculating means for removing said liquid from said second end of said tray and recirculating said liquid to said source;

whereby said source is adapted to pump said liquid through said nozzle with sufficient velocity to create a hydraulic jump whereby a standing wave is created of said liquid elevating said liquid above said second height and directing a relatively turbulent flow of said liquid in a direction against the direction of said wire through said tray; and the dimensions of said slot and said source for controlling the flow rate of said source conforms to the following formula:

$$D = \frac{d}{2}\left[\sqrt{1 + \frac{8}{g} \times \frac{Q^2}{L^2 d^3}} - 1\right]$$

Where

D=wave height d=slot height (distance "x")

g=gravitational constant

Q=flow rate

L=slot width (distance "z").

9. An apparatus as defined in claim 8, wherein said nozzle comprises an elongate having an outlet defined by spaced apart parallel plates defining said slot height and said slot width of said slot, said slot opening onto the floor of said tray in a direction parallel to the plane of said floor.

10. An apparatus as defined in claim 9, wherein said spaced apart parallel plates have a spacing therebetween forming a said slot height of about 6 mm., and said slot width of about 3 feet and said source of liquid metal is adapted to provide said metal at a pressure of between about 22 and 30 psi.

11. An apparatus as defined in claim 8, wherein said recirculating means comprises a reservoir pan mounted beneath said tray and said source comprises a pump means for pumping said liquid from said pan into said nozzle.

12. An apparatus as defined in claim 8, wherein said liquid is pressurized to between approximately 22 psi and 30 psi, and is ejected through said nozzle at a velocity of about 10 ft/sec.

13. An apparatus as defined in claim 8, comprising an annealing station.

14. An apparatus as defined in claim 8 comprising a wire coating station.

* * * * *

UNITED STATES PATENT AND TRADEMARK OFFICE

CERTIFICATE OF CORRECTION

PATENT NO. : 6,306,214 B1 
DATED : October 23, 2001
INVENTOR(S) : Gordon Bernard Cowie and Andrew James Rawlings It is certified that error appears in the above-identified patent and that said Letters Patent is hereby corrected as shown below:

Column 3,
Line 22, “first” should be corrected to -- second --;

Column 4,
Line 52, “first” has been corrected to -- second --;

Column 8,
Line 57, “first” has been corrected to -- second --;

Signed and Sealed this

Thirtieth Day of July, 2002

*Attest:*

*Attesting Officer*

JAMES E. ROGAN
*Director of the United States Patent and Trademark Office*